United States Patent [19]

MacKay et al.

[11] Patent Number: 4,836,116

[45] Date of Patent: Jun. 6, 1989

[54] FLUIDIZED BED COMBUSTION SYSTEM

[75] Inventors: G. David M. MacKay, Halifax; Gordon S. Trivett, Chester, both of Canada

[73] Assignee: The Technical University of Nova Scotia, Nova Scotia, Canada

[21] Appl. No.: 134,038

[22] Filed: Dec. 17, 1987

[51] Int. Cl.[4] ..... F23G 5/00

[52] U.S. Cl. ..... 110/245; 122/4 D; 110/250; 237/1 R

[58] Field of Search ..... 110/245, 250; 122/4 D; 237/1 R

[56] References Cited

U.S. PATENT DOCUMENTS

| | | | |
|---|---|---|---|
| 3,769,922 | 11/1973 | Furlong et al. . | |
| 3,921,590 | 11/1975 | Mitchell et al. . | |
| 4,184,456 | 1/1980 | Taylor et al. . | |
| 4,240,377 | 11/1980 | Johnson . | |
| 4,249,889 | 2/1981 | Kemp . | |
| 4,301,749 | 11/1981 | Urquhart . | |
| 4,306,854 | 12/1981 | Dawson . | |
| 4,312,135 | 1/1982 | Devanney, III . | |
| 4,360,339 | 11/1982 | Blaskowski . | |
| 4,416,418 | 11/1983 | Goodstine et al. | 110/245 |
| 4,434,723 | 3/1984 | Brealey et al. . | |
| 4,453,495 | 6/1984 | Strohmeyer, Jr. . | |
| 4,457,289 | 7/1984 | Korenberg . | |
| 4,465,022 | 8/1988 | Virr . | |

*Primary Examiner*—Henry A. Bennet

*Attorney, Agent, or Firm*—Stevens, Davis, Miller & Mosher

[57] ABSTRACT

A fluidized bed combustion system particularly suited for use in a residential or light industrial heating system comprising a fluidized bed combustor housing a combustion chamber wherein fuel is burned to generate hot flue gas, a heat exchanger disposed inside of the combustion chamber, a particulate collector for removing fine particles entrained in the flue gas before the flue gas is vented to the atmosphere, and a fan for supplying air into the combustion chamber. The combustor features an insulated non-adiabatic combustion chamber with a cooling and heat exchange in the combustion zone and in the free-board area above the combustion zone. Electric heating means are disposed within the fluidizing region of the combuston chamber to provide the capability of heating the slumped bed during shut down to maintain bed temperature above the ignition point. The electric heating means is comprised of rod-shaped electrical resistance heating elements of a commercially available type protruding through the distributor plate into the fluidized bed at a specific inclined position. The control circuitry of the heating elements maintains their surface temperature at a level below about 900° C., preferably below about 750° C. The invention increases operation life of the heating elements by reducing their wear due to corrosion and erosion.

20 Claims, 2 Drawing Sheets

FLUIDIZED BED COMBUSTION SYSTEM

BACKGROUND OF THE INVENTION

The present invention relates to fluidized bed combustors in general and, more particularly, to a fluidized bed combustion apparatus for retrofit in a residential heating system, or in light industrial heating applications.

The use of coal for residential heating or for light industrial heating applications is increasing as the availability of other fuel sources, principally oil and natural gas, decreases and the price of each increases. Wood-burning, while enjoying a rapid increase in popularity, is expected to be restricted by the availability of wood. Wood fuel costs, problems of safety and emerging problems of air pollution combine to limit further expansion of wood as a viable source of fuel for domestic heating systems.

On the other hand, proven coal reserves have been conservatively estimated as sufficient to ensure world energy supply for at least 200 years. Unfortunately, with the conversion to oil since the mid-century, coal combustion development was halted and has only recently surfaced as a focus for major research and development. These research efforts were oriented to solutions to those problems which originally led to the decline in the use of coal and to its replacement by oil. In particular, the problems requiring solution were oriented to quality, storage, handling and transportation, solid waste disposal and, more recently, air pollution. Overall, coal could not compete with the convenience of oil. To allow return to popular use, coal combustion units must therefore be efficient and safe, of low capital cost, flexible in operation and performance, able to accept various types and quality of coal feed, including raw coal and coal/water, coal/oil slurries, and be clean in operation.

Fluidized bed combustion has been identified for over the past two decades as one of the promising technical developments to address the problem of efficiency, cleanliness, cost effectiveness and controllability.

Fluidized bed combustion has been applied on an industrial scale for more than a decade. There are about 200 units in operation in the western world and it is reported that there are some 2,000 units in China. More units produce process steam and hot water, but some are used in other applications such as grass drying. In recent years, there has been increasing interest in fluidized bed combustion for utility application. This is primarily because fluidized bed combustion offers a "front-end" alternative to flue gas scrubbing for reduction of $SO_x$ emissions. The capability arises because a coal fired fluidized bed combustor can be operated at temperatures in the range of 750° C. to 950° C.

Another advantage that the fluidized bed combustor has that makes it attractive in a utility application is that the heat transfer coefficients for surface in the bed can be several times greater than are obtained in conventional boilers. Therefore a fluidized bed combustion boiler can be smaller than a conventional boiler of the same capacity.

Further, the fluidized bed combustor can utilize low and variable quality fuel. For example, it can burn coal that contains up to seventy percent ash. The ability to burn low quality fuel makes fluidized bed combustion viable at the domestic scale.

Prior art fluidized bed furnaces, such as those used to produce steam and hot water, were not suited for application to residential or small industrial scale applications. These prior art fluidized bed furnaces were generally too sluggish for either space heating or small industrial process heating which requires the rapid response to heat load demand and rapid cycling capacity.

Most recently, fluidized bed furnaces have been developed for use in a residential heating system. U.S. Pat. No. 4,416,418, issued on Nov. 22, 1983 to Goodstine et al. discloses a fluidized bed combustion system suitable for use in a residential heating system, comprising a fluidized bed combustor housing an insulated adiabatic combustion chamber wherein crushed fuel is burned to generate hot flue gas, a heat exchanger disposed outside of the combustor in the flow path of the flue gas, a particulate collector for removing fine particles entrained in the flue gas before the flue gas is vented to the atmosphere, and an induced draft fan for venting the flue gas to the atmosphere, drawing fluidized air and recirculating flue gas through the combustion chamber. Electric heating means are disposed within the fluidized region of the combustion chamber to heat the slumped bed during shutdown to maintain bed temperature above the ignition point.

The fluidized bed furnace described by Goodstine et al employs electrical resistance heaters immersed in a horizontal disposition within the particulate material of the fluidized bed. We have discovered that the electrical resistance heaters within the combustion bed of a device as disclosed in Goodstine are subject to a rapid erosion of the heater elements which may result in the failure of the entire heating system.

Additionally, the Goodstine et al furnace utilizes an induced draft fan. Thus the gas duct which recirculates part of the combustion stream to the inlet air plenum is at a positive pressure with respect to the interior of the combustor. This arrangement results in that the flue gas is at a positive pressure with respect to the outer atmosphere. Accordingly, a leak in the flue gas system would permit combustion gases to enter the household.

SUMMARY OF THE INVENTION

The object of the present invention is to provide a fluidized bed combustion system, preferably for residential home heating application but which may also be used for small industrial heating application. A further object of the present invention is to provide a fluidized bed combustion system which alleviates the problems inherent in the fluidized bed combustion systems of prior art.

One of the specific objects of the present invention is to provide a fluidized bed combustion system which utilizes commercially available resistance heaters and which would at least reduce the corrosion and erosion problems inherent with the prior art systems thereby maintaining an acceptable level of reliability and preservation of the quality of the heaters and achieving effecient ignition and maintenance of the bed temperature. Other objects will become apparent as the detailed description of the invention proceeds.

The fluidized bed furnace of the present invention comprises, in combination: a combustion chamber provided with heat exchange means and including a generally horizontal and planar distributor plate having a plurality of air passages therein; a generally horizontal layer of particulate silica material disposed on said distributor plate, said layer also being generally horizontal;

fuel feed means operatively associated with the furnace and adapted to supply particulate fuel to an area at the top of said layer; combustion air supply means communicating with a chamber below the distributor plate, said plate separating the chamber from the said layer; elongated rod-shaped electric resistance heating elements protruding into said layer and disposed at a predetermined angle of about 30° to about 90° relative to a normally generally horizontal plane defined by said distributor plate; means for selectively controlling (1) the amount of air blown by said air supply means through said distributor plate and (2) the amount of fuel supplied by said fuel feed means; temperature control means for maintaining the temperature of said heating elements below a predetermined maximum temperature of about 900° C., preferably below about 880° C.

In another aspect, the present invention provides a fluidized bed furnace featuring an insulated nonadiabatic combustion chamber with cooling and heating exchange surrounding or within the combustion zone and the freeboard area above the combustion zone. A particulate collector is water cooled as part of the heat exchange system, thereby resulting in the cooling of the flue gas prior to the expulsion of the flue gas out the stack. Downstream of the particulate collector is, optionally, a bag filter or other particulate collection device for cleaning the cooled flue gas such that when in place, and in conjunction with the air blower downstream of the collection unit, the furnace operates with balanced draft and, alternately, with positive draft if the bag filter is not fitted and an air supply fan is located upstream of the inlet air plenum.

Preferably, the fluidized bed material is formed of inert high temperature particulate material including silica material. In one embodiment, the particulate silica material is sand having mean particle diameter of 800–1000 microns. The heating elements are preferably elongated rod-shaped electric heating elements which protrude through the horizontal distributor plate into the layer of particulate material at an angle of about 30° to about 90°. Each element is immersed in the layer of particulate material which forms the fluidized bed, when the layer is in a non-fluidized, slumped state.

The furnace is adapted for the combustion of solid particulate material, including coal, but also liquid fuels including coal slurries.

In an embodiment where the fuel is a coal slurry, a fuel feeding means is utilized which includes a storage tank, optionally a pump operatively associated with the tank for recirculation of the slurry. Additionally, the pump is connected to a line provided with a flow control valve means and discharges near the top of the bed.

DETAILED DESCRIPTION OF PREFERRED EMBODIMENTS OF THE INVENTION

Figure 1:
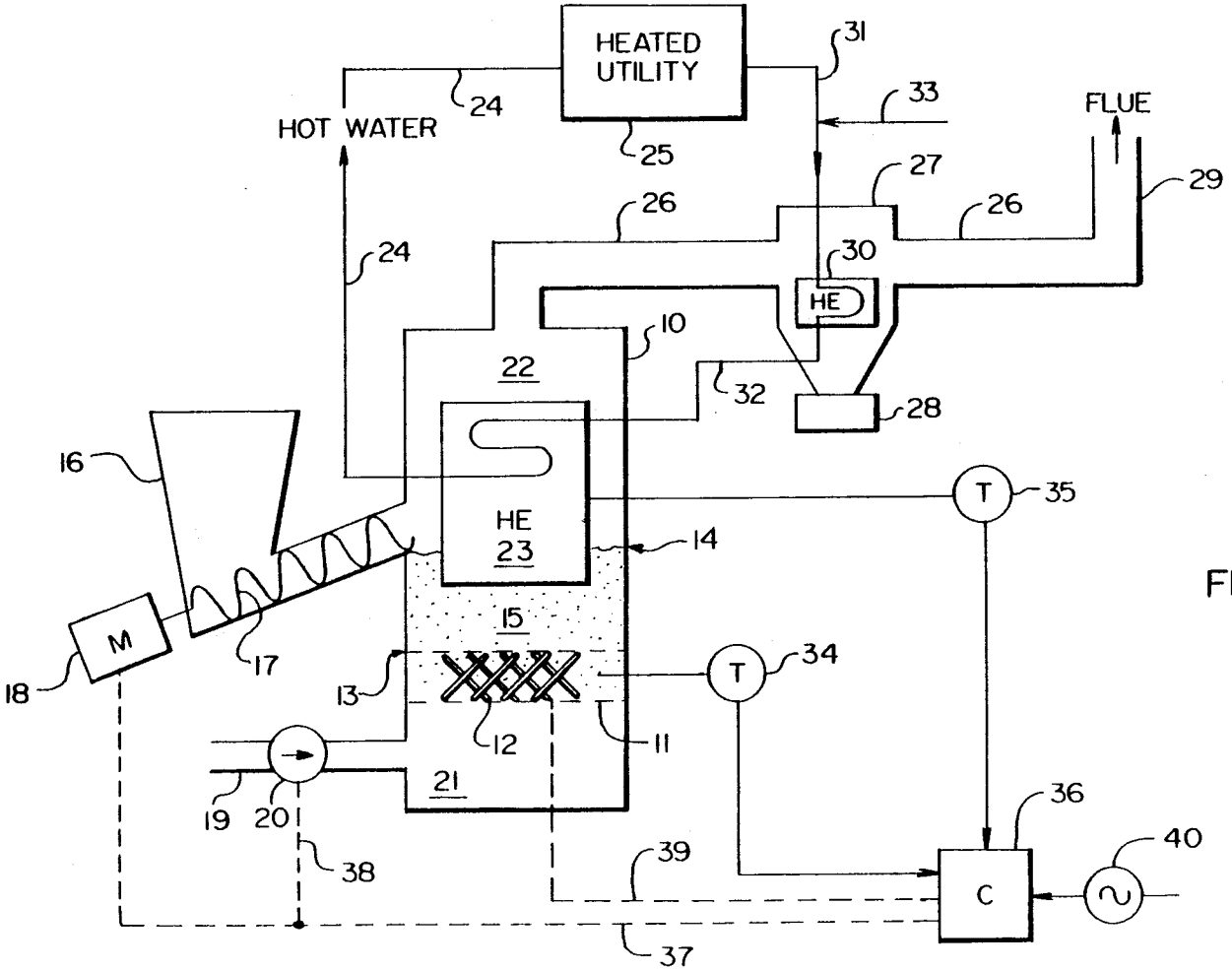
FIG. 1 is a simplified diagrammatic representation of a fluidized bed combustor of the present invention.

Turning firstly to the embodiment of FIG. 1, the drawing shows a diagrammatic of a fluidized bed arrangement according to the present invention. The arrangement is comprised of several interconnected elements. A cylindric combustion chamber 10 is provided with a distributor plate 11 which is air permeable. The combustion plate 11 is generally horizontal and supports a plurality of heating elements 12. In the preferred embodiment, the heating elements 12 are inclined with respect to the level of the distributor plate 11 at an angle of approximately 30°. The heating elements 12 are of commercially available type. Each heating element is a commercially available rod-shaped element of the type provided with a stainless steel, heat resistant skin or sheathing on its surface. The control circuitry of the heating elements is also of a commercially available type. It includes a thermo-couple element operatively associated with the system to control the supply of electricity to the elements such as to maintain the surface temperature of the elements at a level below about 900° C., preferably below about 880° C. The control devices of this type are commercially available and therefore do not have to be described in detail. The arrangement of the heating elements 12 is on a circle whose radius is approximately one-half of that of the combustion chamber 10. The heating elements 12 are so arranged, from the standpoint of their height and overall arrangement, that they do not reach above the level 13 which marks the top of a slumped bed. The numeral 14 denotes the expanded bed level. The bed 15 is formed by particulate silica material or sand having mean particle diameter of 800–1000 microns. Thus, turning back to the arrangement of the heating elements 12, the elements are of such length and an angle relative to the distributor plate 11 and the level 13 that it is assured that each element or active heating segment thereof is completely immersed in the layer of the bed 15 when it is in a non-fluidized, slumped state.

A fuel feeding means is operatively associated with the combustion chamber and is adapted to supply particulate fuel to an area at the top of the layer of the bed 15, approximately at the level 14.

In the shown embodiment, the fuel feeding means includes a hopper 16 for crushed, particulate coal and operatively associated at its bottom with an auger 17 whose discharge is disposed just above the level 14 of the combustion chamber 10 or alternatively between the level 13 and the level 14 of the combustion chamber 10. A motor 18 is provided to selectively drive the auger 18.

The device is further provided with a combustion air supply means communicating with a chamber below the distributor plate 11 which separates the chamber from the layer of bed 15. In the shown embodiment, the combustion air supply means includes an air inlet 19 provided with a fan 20. The inlet 19 terminates in wind box or plenum 21 of the combustion chamber 10. The upper portion of the combustion chamber 10 is so-called freeboard 22. Thus, it can be said that the interior of the combustion chamber 10 is divided into three parts, namely the plenum 21, the bed 15 and the freeboard 22. A heat exchanger 23 is shown as being disposed within the freeboard 22 and partly also in the bed 15. The heat exchanger 23 can be arranged to also surround the bed and freeboard area, as is well known in the art. The heat exchanger 23 is designated with a rectangle, it being understood that this is merely a simplified diagrammatic representation and that in the actual embodiment of the heat exchanger would be formed, for instance, by a piping system secured to the walls of the combustion chamber 10. The discharge end of the heat exchanger communicates with a heated utility, for instance a single family dwelling hot water radiators, via a heating line 24. The line 24 is operatively associated with the heated utility 25 at its inlet. The freeboard 22 is further provided with an exhaust duct 26. In the shown embodiment, there is a centrifugal particle separator 27 mounted within the duct 26. The separator is of a well known arrangement and is designed to accumulate within its collecting container 28 a very substantial part of the particles contained in fuel gas flowing through the exhaust duct 26. At the downstream end of the duct 26 is arranged a stack 29. The centrifugal particle separator 27 is provided with a heat exchanger 30 whose inlet is supplied with water line 31 for normally lukewarm water flowing from the heated utility 25. The discharge of the heat exchanger 30 communicates, via a line 32, with the inlet of the heat exchanger 23. Thus, the heat exchanger 23, the line 24, the utility 25, the line 31, the heat exchanger 30 and the line 32 are arranged in an enclosed circuit which can be provided, at a suitable location, with a fresh water inlet 33.

A temperature sensor 34 reaches into the bed 15 to continuously follow the temperature of the bed in the region of the slumped bed. Thus, the sensor 34 is capable of following the temperature in the slumped bed area while a second sensor 35 follows the temperature within the freeboard 22. The output of each of the sensors 34 and 35 is directed to the input of a controller 36. The controller 36 has its output lines (shown in broken line) operatively associated with three elements, namely with the motor 18, with the fan 20 and with the heating elements 12. The output line of the controller 36 to the motor 18 is designated with reference numeral 37. It branches off towards the fan 20 at line 38.

A second output line 39 is operatively associated with the heating elements 12. Accordingly, the line 39 communicates, when activated, a source 40 of alternating current to activate the heating elements 12.

Figure 2:
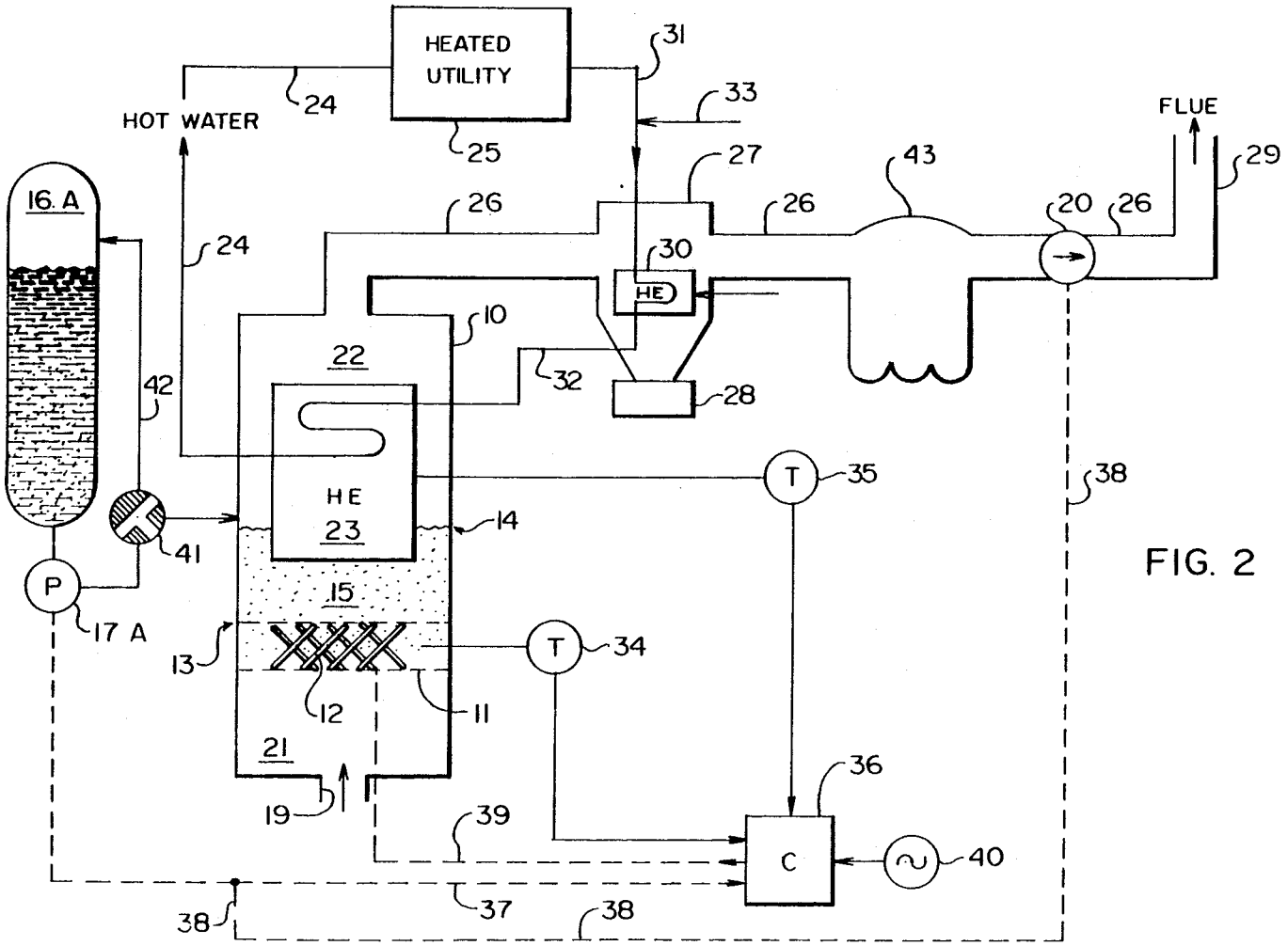
FIG. 2 is a simplified diagrammatic representation of another, preferred, embodiment thereof.

Turning now to FIG. 2, it will be seen that the overall arrangement is very similar to that of FIG. 1. Inasmuch as there are many elements of the arrangement of FIG. 2 which form functional equivalents of the elements of FIG. 1 and are often of identical structure, the same reference numerals are used for the corresponding items.

Thus, in FIG. 2, a combustion chamber 10 is provided with a distributor plate 11 supporting a number of heating elements 12. As in FIG. 1, reference numerals 13 and 14 designate the slumped and expanded bed level, respectively. The particulate bed 15 is of the same kind as that in FIG. 1 and is designated with reference numeral 15.

The first difference from the arrangement of FIG. 1 is in the particulate fuel feeding means. Instead of the hopper 16, a container 16A is used which is adapted to operate with a coal slurry. In such arrangement, of course, the auger 17 is replaced with a pump 17A. A three-way valve 41 is used to selectively direct the slurry pumped from the container 16A via the pump 17A, either towards the combustion chamber 10 at the level 14 or, in an alternative, the slurry can be recirculated through the return line 42 back to the container 16A. In the further alternative, by employment of a suitable multiple-port valve, the slurry may be pumped via the pump 17A towards both the combustion chamber 10 at the level 14 and recirculated through the return line 42 back to the container 16A. There is no counterpart of element 18, the motor driving the auger 17 of FIG. 1 unless the drive motor of the pump 17A is considered to be such a counterpart.

As in FIG. 1, reference numeral 19 denotes a combustion air inlet. Contrary to the arrangement of FIG. 1, the air inlet is not provided with a pump. The pump 20 is now disposed at the downstream end of the system as will be referred to later on. The combustion chamber 10 of FIG. 2, also has a plenum 21 and a freeboard 22 with a heat exchanger 23 disposed within the latter. The heating line 24 communicates the heat exchanger 23 with the heated utility 25. The freeboard 22 also communicates, via an exhaust duct 26, with a centrifugal particle separator 27 provided with a collector 28. The downstream extremity of the conduit or duct 26 is in communication with a flue 29.

The second difference between the arrangement of FIG. 2 and of FIG. 1 is further seen in the arrangement of the downstream end of the exhaust duct 26. There is provided in the duct 26 a bag filter 43 or collection device adapted to catch any particulate impurities that may have passed through the centrifugal particle separator 27. Thus, the purity of the gas flowing through the stack 29 is improved. As mentioned before, the functional counterpart of the fan 20 of FIG. 1 is a fan 20 which is now disposed at the downstream end of duct 26, between the bag filter 43 and the stack 29.

The remainder of the arrangement of FIG. 2 is again virtually identical with that of FIG. 1 and includes a line 31 communicating the heated utility with the heat exchanger 30. Line 32 communicates the heat exchanger 30 with the heat exchanger 23 to enclose the circuit as in the first embodiment. The fresh water line 33 of the line 31 is also virtually identical with that of FIG. 1.

As in the preceding embodiment, the embodiment of FIG. 2 includes a sensor 34 for measuring temperature within the slumped bed 15 and optionally another sensor 35 for sensing the temperature within the freeboard 22. The controller 36 controls the operation of the pump 17A via control line 37 from which branches off a line 38 connecting the controller 36 with the fan 20. As in the first embodiment, the control line 39 communicates the controller 36 with the heating element 12 to selectively activate or deactivate the heating of same, utilizing the source 40 of alternating current.

The operation of the present invention will now be described referring first to the embodiment of FIG. 1. At the outset, the bed 15 is in its slumped state and reaches only up to the level 13. Before starting the entire operation, the heating elements 12 are first activated such as to first bring to and later to maintain the temperature of the bed 15 in slumped state at a value at which re-ignition of the bed can be obtained upon supply of combustion air. In most instances, such temperature is at about 400° C. When such temperature of the slumped 15 is obtained (sensed by sensor 34), the operation of the fan 20 and of the motor 18 is started virtually simultaneously. This results in combustion air being introduced via duct 19 into the plenum 21 raising the level of the bed 15 to the expanded level 14 to which the particulate coal is now being delivered by the auger 17 in a continuous manner. In the shown embodiment, hot water is delivered to the heated utility 25 and the spent, cold or lukewarm water is brought back to the heat exchanger 27. Small particles forming the mixture of the sand and of the fuel in bed 15, may escape to the separator 27. They are separated from the flue gas flowing through the exhaust pipe 26 so that the discharge at the stack 29 is relatively clean. The heat exchanger 30 communicates at its outlet with the heat exchanger 23 disposed within the freeboard and thus acts as a preheater of the heat exchanger 23 to improve the efficiency of the overall arrangement. When the temperature in the freeboard 22 exceeds a predetermined level, the temperature sensor 35 sends an impulse to the controller 36 which then shuts the operation of the motor 18 and fan 20 virtually simultaneously. The bed 15 now reaches again its slumped state. At this point, the temperature of the bed within the slumped area will be generally higher than the predetermined temperature of about 400° C. Accordingly, the temperature sensor 34 will not provide a signal for activation of heating elements 12. Such signal is only produced when the temperature drops to about 400° C., to maintain the slumped bed 15 at a predetermined temperature level. The heating elements 12 utilize a regular alternating current source usually drawn from the regular hydro power network. The source is diagrammatically referred to with reference numeral 40. The power is also used in driving the remaining elements such as the fan 20 or the motor 18.

Virtually the same arrangement is operative in FIG. 2. Here the controller 36 is operatively associated with the identical controlled elements. The difference in the arrangement of FIG. 2 is, firstly, that the controller operates a slurry pump 17A. The valve 41 is an optional arrangement which may be preferred if it is desired to run the pump 17A continuously while merely switching the valve 41 from a position wherein it feeds the slurry into the combustion chamber 10 or returns same via line 42 back to the container 16A, as is well known in the art of recirculation of liquids or slurries.

The second embodiment shown in FIG. 2 is generally preferred not only because of the arrangement of optional bag filter 43 the operation of which is enabled by the cooling down of the particles flowing through the centrifugal particle separator 27 but also due to the fact that the entire system is subjected to suction as opposed to the pressurized arrangement of FIG. 1. Accordingly, the second embodiment is less likely to give rise to leaks of fumes or the like into the dwelling.

Those skilled in the art will appreciate that the above two embodiments can be modified to a greater or lesser degree without departing from the scope of the present invention as recited in the accompanying claims.

I claim:

1. A fluidized bed furnace, particularly a residential or light industrial furnace for use in heating a single family dwelling or the like, comprising, in combination:

(a) a combustion chamber provided with heat exchange means and including generally horizontal and planar distributor Plate having a plurality of air passages therein;

(b) a generally horizontal layer of particulate silica material disposed on said distributor plate, said layer also being generally horizontal;

(c) fuel feeding means operatively associated with the combustion chamber and adapted to supply particulate fuel to an area at the top of said layer;

(d) combustion air supply means communicating with a chamber below the distributor plate, said plate separating the chamber from the said layer;

(e) elongated rod-shaped electrical resistance heating elements protruding into said layer and disposed at an angle of about 30° to 90° relative to a normally generally horizontal plane defined by said distributor plate;

(f) means for selectively controlling (11) the amount of air blown by said air supply means through said distributor plate and (2) the amount of fuel supplied by said fuel feeding means;

(g) temperature control means adapted to maintain the temperature of the heating elements at the surface thereof at below about 900° C.

2. A furnace as claimed in claim 1, wherein the temperature control means is adapted to maintain said temperature of the heating elements below about 750° C.

3. A furnace as claimed in claim 1, wherein said heating elements include each a stainless-steel tubular sheathing coextensive with and closely enveloping the element.

4. A furnace as claimed in claim 1, wherein said heating elements are fixedly secured to a generally horizontal distributor plate disposed below said distributor plate, the heating elements passing through the distributor plate.

5. A furnace as claimed in claim 1, wherein the length and the said predetermined angle of the heating element are selected such as to assure that each element is immersed in said layer when the layer is in a non-fluidized, slump state.

6. A furnace as claimed in claim 1, wherein the predetermined level of the temperature of said heating elements is such as to maintain the temperature of the bed in slumped state at a value at which re-ignition of the bed can be obtained upon supply of combustion air.

7. A furnace as claimed in claim 6, wherein said value is about 400° C.

8. A furnace as claimed in claim 1, wherein the particulate silica material is sand of mean particle diameter of 800–1000 microns.

9. A furnace as claimed in claim 1, wherein the fuel feeding means is a coal slurry feeding means.

10. A furnace as claimed in claim 9, wherein the coal slurry feeding means is of the type including a storage tank, a pump operatively associated with the tank for recirculation of the slurry, said pump being also connected to a line provided with a flow control valve means and discharging near the top of the bed.

11. A fluidized bed furnace, particularly a residential or light industrial furnace for use in heating a single family dwelling or the like, comprising, in combinations;

(a) a combustion chamber provided with a generally horizontal and planar distributor plate having a plurality of air passages therein;

(b) a generally horizontal layer of particulate silica material disposed on said distributor plate, said layer also being generally horizontal;

(c) fuel feeding means operatively associated with the furnace and adapted to supply fuel to an area at the top of said layer;

(d) combustion air supply means communicating with a chamber below the distributor plate, said plate separating the chamber from the said layer;

(e) elongated rod-shaped electrical resistance heating elements protruding into said layer and disposed at an angle of about 30° to about 90° relative to a plane defined by said distributor plate;

(f) a heat exchanger provided within the freeboard region of said combustion chamber and said heat exchanger having a plurality of heat exchanger tubes and wherein said heat exchanger is in fluid communication with a particle separator by a cold water inlet such that said particle separator is cooled by the cold water supply prior to entering said heat exchanger;

(g) means for selectively controlling (1) the amount of air blown by said air supply means through said distributor plate and (2) the amount of fuel supplied by said fuel feeding means;

(h) temperature control means for maintaining the temperature of said heating elements at the surface thereof at a level of below about 900° C.

12. A furnace as claimed in claim 11, wherein said heating elements include each a stainless-steel tubular sheathing coextensive with and closely enveloping the element.

13. A furnace as claimed in claim 11, wherein said heating elements are fixedly secured to a generally horizontal distributor plate disposed below said distributor plate, the heating elements passing through the distributor plate.

14. A furnace as claimed in claim 11, wherein the length and the said predetermined angle of the heating element are selected such as to assure that each element is immersed in said layer when the layer is in a non-fluidized, slump state.

15. A furnace as claimed in claim 11, wherein the predetermined level of the temperature of said heating elements is such as to maintain the temperature of the bed in slumped state at a value at which re-ignition of the bed can be obtained upon supply of combustion air.

16. A furnace as claimed in claim 15, wherein said value is about 400° C.

17. A furnace as claimed in claim 11, wherein the particulate silica material is sand of mean particle diameter of 800–1000 microns.

18. A furnace as claimed in claim 11, wherein the fuel feeding means is a coal slurry feeding means.

19. A furnace as claimed in claim 11, wherein the coal slurry feeding means is of the type including a storage tank, a pump operatively associated with the tank for recirculation of the slurry, said pump being also connected to a line provided with a flow control valve means and discharging near the top of the bed.

20. A furnace as claimed in claim 10, wherein the temperature control means is adapted to maintain said temperature of the heating elements below about 750° C.

* * * * *